US005885953A

United States Patent [19]

Jadesjö et al.

[11] Patent Number: 5,885,953

[45] Date of Patent: Mar. 23, 1999

[54] CHEMICAL COMPOSITION

[75] Inventors: Gunilla Jadesjö, Kungälv; Gunnil Jönsson, Nol, both of Sweden

[73] Assignee: EKA Chemicals AB, Bohus, Sweden

[21] Appl. No.: 976,623

[22] Filed: Nov. 24, 1997

[30] Foreign Application Priority Data

Nov. 29, 1996 [SE] Sweden ..... 9604414

[51] Int. Cl.[6] ..... C11D 3/395; C11D 7/18; C11D 7/54; C11D 7/56

[52] U.S. Cl. ..... 510/372; 510/309; 510/375; 510/469

[58] Field of Search ..... 510/372, 375, 510/309, 469

[56] References Cited

U.S. PATENT DOCUMENTS

| | | | |
|---|---|---|---|
| 3,833,517 | 9/1974 | Kling et al. | 252/545 |
| 3,860,391 | 1/1975 | Kling et al. | 8/111 |
| 3,899,496 | 8/1975 | Schindler et al. . | |
| 3,954,401 | 5/1976 | Kling et al. | 8/127 |
| 3,979,385 | 9/1976 | Wollmann et al. . | |
| 4,098,814 | 7/1978 | Sommer et al. | 260/502.5 |
| 4,418,019 | 11/1983 | Klose et al. | 260/502.5 C |
| 4,670,253 | 6/1987 | Ploog et al. | 424/70 |
| 4,803,068 | 2/1989 | Ploog et al. | 424/70 |

FOREIGN PATENT DOCUMENTS

| | | |
|---|---|---|
| 0 087 049 | 11/1986 | European Pat. Off. . |
| 0 517 996 | 6/1991 | European Pat. Off. . |
| WO 91/08981 | 6/1991 | European Pat. Off. . |
| WPI | | |
| 88-004846/01 | 11/1987 | Japan . |
| WPI | | |
| 93-004727/01 | 11/1992 | Japan . |
| WO 93/14183 | 7/1993 | WIPO . |
| WO 94/07803 | 4/1994 | WIPO . |

OTHER PUBLICATIONS

Masahiro Fukuda, et al, "Synthesis of 1–Dialkylaminoalkylidendiphosphonic Acids and Thier Properties for Complex Formation," *Japan Oil Chemistry Society*, vol. 4–22, Jun. 25, 1996, pp. 362–364.

*Primary Examiner*—Paul Lieberman
*Assistant Examiner*—John M. Petruncio
*Attorney, Agent, or Firm*—McDermott, Will & Emery

[57] ABSTRACT

The invention relates to a composition suitable for cleaning disinfection and bleaching comprising an acidic aqueous solution of hydrogen peroxide, a surfactant, and a phosphonic acid based complexing agent selected from biodegradable 1-aminoalkane-1,1-diphosphonic acids, or salts thereof, of the formula:

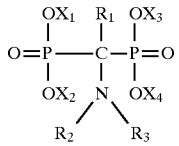

wherein $R_1$ is selected from hydrogen, $C_1$–$C_4$ alkyl and phenyl; $R_2$ and $R_3$, independently from each other, are selected from hydrogen, $C_1$–$C_{22}$ alkyl, $C_5$–$C_6$ cycloalkyl, phenyl, $C_7$–$C_{18}$ alkylphenyl, $C_7$–$C_{18}$ phenylalkyl, a $C_1$–$C_{10}$ alkanol radical, a carboxy alkyl radical having up to 10 carbon atoms, wherein $R_2$ and $R_3$ together with the nitrogen atom can form a piperidino, pyrrolidino or a morpholino group; and $X_1$ to $X_4$, independently from each other, are selected from hydrogen, alkali metal and ammonium. The invention also relates to use of such a composition for disinfection, bleaching, removal of stains from textiles, or removal of lime deposits.

10 Claims, No Drawings

CHEMICAL COMPOSITION

The present invention relates to an acidic aqueous composition suitable for cleaning, disinfection and/or bleaching comprising hydrogen peroxide, as well as use of such a composition.

Hard surface cleaning and disinfection, laundry bleaching and stain-removal, domestic as well as industrial, is often performed with chlorine based chemicals such as hypochlorite in aqueous solution which generally is effective for disinfection and bleaching, or organic solvents, enzymes and surfactants effective for stain removal and cleaning. However, hypochlorite is not useful for removing lime soap and it may also damage textile fibres and the original colours thereof. Further, for environmental reasons it is desirable to avoid chlorine based cleaning agents.

Hydrogen peroxide is known as an environmental friendly oxidiser and disinfectant, but to be efficient a rather high concentration or/and a long contact time is necessary. In the bacterial cell hydrogen peroxide reacts with —SH groups and thereby destroys SH containing enzymes and inhibit the protein synthesis. However, hydrogen peroxide has a poor storage stability, particularly in combination with other ingredients such as surfactants or organic acid. Although the hydrogen peroxide stability can be improved by addition of chelating agents like phosphonates, it is hard to find a phosphonate that both is biodegradable and effective as a hydrogen peroxide stabiliser.

EP-B1-87049 discloses a composition for disinfection comprising hydrogen peroxide, an acidic phosphorous compound such as phosphoric acid, and a complexing agent selected from certain phosphonic acids or salts thereof.

EP-A1-517996 discloses a hydrogen peroxide based bleaching composition comprising a specific class of surfactants.

WPI Acc. No 93-004727/01, abstract of JP-A-4332800 discloses a detergent composition comprising hydrogen peroxide, an organic or inorganic acid, and a carboxylic acid type polymer.

WPI Acc. No 88-004846101, abstract of JP-A-62270509 discloses a composition for removing marine creatures from constructions used in sea water, the composition comprising citric acid, hydrogen peroxide and a surfactant.

WO 93/14183 discloses a detergent composition comprising a surfactant, oxygen bleach such as hydrogen peroxide and a metal sequestering agent.

WO 91/08981 discloses a solution for stabilizing hydrogen peroxide comprising citric acid, tartaric acid and phosphoric acid.

WO 94/07803 discloses the use of a composition comprising an oxidising agent, an organic acid and a phosphonic acid for removing magnetite deposits in water supply systems.

It is an object of the present invention to provide a storage stable composition based on hydrogen peroxide which is effective for several functions including cleaning, bleaching, disinfection, removal of stains on textiles and optionally removal of lime deposits. It is another object of the invention to provide a composition only containing environmentally acceptable components. The composition according to the invention comprises an acidic aqueous solution of hydrogen peroxide, a surfactant, and a phosphonic acid based complexing agent selected from biodegradable 1-aminoalkane-1,1-diphosphonic acids, or salts thereof, of the formula:

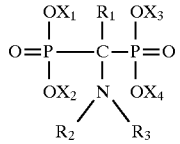

wherein $R_1$ is selected from hydrogen, $C_1$–$C_4$ alkyl and phenyl; $R_2$ and $R_3$, independently from each other, are selected from hydrogen, $C_1$–$C_{22}$ alkyl, $C_5$–$C_6$ cycloalkyl, phenyl, $C_7$–$C_{18}$ alkylphenyl, $C_7$–$C_{18}$ phenylalkyl, a $C_1$–$C_{10}$ alkanol radical, a carboxy alkyl radical having ing up to 10 carbon atoms, wherein $R_2$ and $R_3$ together with the nitrogen atom can form a piperidino, pyrrolidino or a morpholino group; and $X_1$ to $X_1$, independently from each other, are selected from hydrogen, alkali metal and ammonium. Preparation of such phosphonic acids are described in, for example, U.S. Pat. No. 3,899,496, U.S. Pat. No. 3,979,385 and "Synthesis of 1-dialkylaminoalkylidene diphosphonic acids and their properties for complex formation", Fukuda, M., et al, Yukagaku, Vol. 25, No. 6, pp. 362–64 (1976).

Preferably $R_1$ is hydrogen. It is also preferred that $R_2$ and $R_3$ are selected from hydrogen, $C_1$ to $C_4$ alkyl, or together with the nitrogen form a morpholino group. Particularly preferred complexing agent are selected from morpholinomethane diphosphonic acid, N,N-dimethyl aminodimethyl diphosphonic acid, aminomethyl diphosphonic acid, or salts thereof, preferably sodium salts.

The composition suitably contains one or several phosphonic acid based complexing agents according to the description above in an amount from about 0.5 wt % to about 10 wt %, preferably from about 1 wt % to about 4 wt % based on the content of hydrogen peroxide.

Suitably, the pH of the composition is below 6, preferably below 4, most preferably below 3, which enhances the antimicrobial activity as well as the capability of removing lime in, for example, bath tubs, toilet bowls or the like. A low pH also improves the stability of the hydrogen peroxide. However, the pH preferably is above about 0.5, most preferably above about 2.

Although possible, it is preferred not to include any substantial amounts of acids apart from small amounts of phosphonic acids according to the description above because most organic acids have a negative influence of the hydrogen peroxide stability and most inorganic acids like phosphoric acid are not desirable from an environmental point of view.

The surfactant facilitates removal of dirt and especially non-ionic surfactants are excellent on removing fat and pigments but they also enhance the antimicrobial effect as they destroy bacterial cell membranes. Preferred surfactants are compatible with hydrogen peroxide in acidic solutions which means that neither do they cause decomposition of the hydrogen peroxide, nor does the hydrogen peroxide or the acid cause decomposition of the surfactants. Further, the surfactants are preferably environmental friendly and biodegradable.

The composition contains one or several different surfactants. Preferably, it comprises a non-ionic surfactant or an amphoteric surfactant or a mixture thereof. Although not preferred, it is also possible to include anionic surfactants as an alternative or as a complement.

Preferred non-ionic surfactants are selected from ethoxylated fatty acids, alcohols, amines or amides, preferably comprising from 1 to 12 most preferably from 4 to 8 mols ethylene oxide per mol acid, alcohol, amine or amide. Preferably the acid, alcohol or amide comprises from 7 to 15, most preferably from 9 to 11 carbon atoms. Useful non-ionic surfactants can be high foaming such as an ethoxylated alcohol containing 11 carbon atoms and 8 ethylene oxides, or low foaming such as a narrow range ethoxylated alcohol containing 9 carbon atoms and 6 ethylene oxides.

Preferred amphoteric surfactants are selected from derivatives of preferably aliphatic amines comprising one or more anionic groups such as carboxy, sulfo, or sulfato. Particularly preferred amphoteric surfactants satisfy the formula:

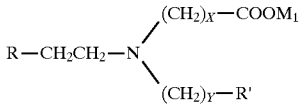

wherein x and y are, independently from each other, from 1 to 5, R' is —$COOM_2$ or —OH, $M_1$ and $M_2$ are, independently from each other, H, ammonium or an alkali metal such as Na, K or Li, R is a straight or a branched carbon chain having from 1 to 8 carbon atoms or an amide of the formula:

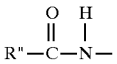

wherein R" is a straight or a branched carbon chain having from 1 to 8 carbon atoms. It is preferred that R' is $COOM_2$ and that R is a straight or a branched carbon chain. Examples of preferred amphoteric surfactants are octylimino dipropionate and capryloampho diacetate which are commercially available under the trademarks Ampholak® YJH40 (Akzo Nobel) and Ampholak® XJO (Akzo Nobel), respectively.

A composition of the invention can be in the form of a concentrate intended to be diluted before use. Such a concentrate may suitably contain from about 10 wt % to about 60 wt %, preferably from about 30 wt % to about 50 wt % of hydrogen peroxide, from about 5 wt % to about 30 wt %, preferably from about 10 wt % to about 20 wt % of surfactants, and from about 0.05 wt % to about 10 wt %, preferably from 1 wt % to about 5 wt % of phosphonic acid based complexing agents as earlier described. The balance is preferably mainly made up of water. The pH of the concentrate is suitably from about 0.5 to about 6, preferably from about 1 to about 3. Such a composition is preferably diluted from 10 to about 50 times before use and is then particularly suitable for cleaning and disinfection of hard surfaces, particularly in the food industry where it is important to destroy human pathogenic as well as product spoiling microorganisms and spores.

A ready to use composition suitable for cleaning, disinfection or stain removal in households suitably contains from about 0.1 wt % to about 10 wt %, preferably from about 4 wt % to about 6 wt % of hydrogen peroxide, from about 0.1 wt % to about 10 wt %, preferably from about 2 wt % to about 6 wt % of surfactants, and from about 0.01 wt % to about 5 wt % , preferably from about 0.1 wt % to about 1 wt % of phosphonic acid based complexing agents as earlier described. The balance is preferably mainly made up of water. The pH of the composition is suitably from about 1.5 to about 6, preferably from 2 to 4. The composition is very effective for cleaning surfaces in kitchens and bathrooms and for removing stains from textiles. It can also be used outdoors for removing or inhibiting growth of mould or algae on wood or other materials. If appropriate, it can be combined with an ordinary alkaline detergent to improve bleaching on laundry.

The composition of the invention can easily be prepared by simply mixing the components to desired concentrations.

The invention also relates to use of a composition as described herein for disinfection, bleaching, removal of stains from textiles, or removal of lime deposits.

The invention is further illustrated through the following examples which, however, is not intended to limit the scope of the invention. If not otherwise stated, all contents and percentages refer to % by weight.

EXAMPLE

A composition according to the invention having a pH of 3.1 and consisting of an aqueous solution of 5% hydrogen peroxide, 2.5% of ethoxylated $C_{10}$–$C_{14}$ fatty alcohols with 7 mols ethylene oxide and 1 mol propylene oxide as a high foaming non-ionic surfactant, 2.5% of ethoxylated $C_{16}$–$C_{18}$ amide with 4 mols ethylene oxide as a low foaming non-ionic surfactant, and 0.05% of morpholinomethane diphosphonic acid was prepared by mixing the components. The stability of the hydrogen peroxide was tested by storing the composition 42 days at 40° C. It was found that 99.8% of the hydrogen peroxide remained.

The capability of removing stains from coloured pieces of cloth was tested for the above composition and, as a comparison, for a commercially available hypochlorite based composition sold under the trademark Klorin®. The stains were applied thoroughly and dried. The two compositions, were applied on the stains during 6 hours and the pieces of cloth were then washed in a machine with a detergent not containing any bleaching agent. The pieces of cloth were made from different fibers: cotton, polyester, silk, viscose and wool, and the original colours were dark blue and beige. The efficiency was judged visually and the different samples were marked on a scale from 0–3 where 3 means complete removal of the stain. The results appear in table 1.

TABLE 1

| | Stain removal | |
|---|---|---|
| Stain | Invention | Klorin ® |
| red wine | 3 | 3 |
| chocolate | 3 | 2 |
| coffee | 3 | 3 |
| tea | 3 | 3 |
| blueberry | 3 | 2 |
| brown sauce | 2 | 1 |

Table 2 below shows the damage to the fibers and the decolouration and is marked on a scale from 0–3 where 3 means a sharp visual damage and decolouration and 0 means no damage. Klorin® was diluted 10 times before application. After 2 hours of treatment the pieces of cloth were rinsed in warm water.

TABLE 2

| | Influence on fiber and colour | | | |
|---|---|---|---|---|
| | Invention | | Klorin ® diluted 1:10 | |
| | Fiber damage | Colour bleaching | Fiber damage | Colour bleaching |
| Cotton | 0 | 0 | 0 | 3 |
| Polyester | 0 | 0 | 0 | 1 |
| Silk | 0 | 0 | 3 | 3 |
| Wool | 0 | 0 | 3 | 0 |
| Viscose | 0 | 0 | 0 | 3 |

It was found that the both original colour and the fibres of the pieces of cloth treated with Klorin® had been damaged, while no such effect could be observed on the pieces treated with the composition of the invention.

We claim:

1. An acidic composition having a pH not greater than 6 suitable for cleaning, disinfection and/or bleaching characterised in that it comprises, an aqueous solution of hydrogen peroxide, a surfactant, and a phosphonic acid based complexing agent selected from biodegradable 1-aminoalkane-1,1-diphosphonic acids, or salts thereof, of the formula:

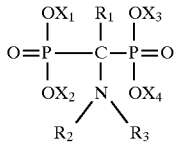

wherein $R_1$ is selected from hydrogen, $C_1$–$C_4$ alkyl and phenyl; $R_2$ and $R_3$, independently from each other, are selected from hydrogen, $C_1$–$C_{22}$ alkyl, $C_5$–$C_6$ cycloalkyl, phenyl, $C_7$–$C_{18}$ alkylphenyl, $C_7$–$C_{18}$ phenylalkyl, a $C_1$–$C_{10}$ alkanol radical, a carboxy alkyl radical having up to 10 carbon atoms, wherein $R_2$ and $R_3$ together with the nitrogen atom can form a piperidino, pyrrolidino or a morpholino group; and $X_1$ to $X_4$, independently from each other, are selected from hydrogen, alkali metal and ammonium.

2. Composition as claimed in claim 1, characterised in that $R_1$ is hydrogen.

3. Composition as claimed in claim 2, characterised in that the composition comprises a complexing agent selected from morpholinomethane diphosphonic acid, N,N-dimethyl aminodimethyl diphosphonic acid, aminomethyl diphosphonic acid, or salts thereof.

4. Composition as claimed in claim 1, characterised in that composition contains one or several phosphonic acid based complexing agents according to any on of the claims 1–3 in an amount from about 0.5 wt % to about 10 wt % based on the content of hydrogen peroxide.

5. Composition as claimed in claim 1, characterised in that the pH of the aqueous solution is below 6.

6. Composition as claimed in claim 1, characterised in that the composition does not comprise any substantial amounts of phosphoric acid or phosphates.

7. Composition as claimed in claim 1 characterised in that the composition comprises a non-ionic surfactant or an amphoteric surfactant or a mixture thereof which is compatible with hydrogen peroxide in acidic solution.

8. Composition as claimed in claim 7, characterised in that the composition comprises an amphoteric surfactant satisfying the formula:

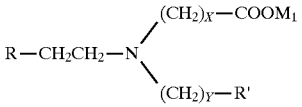

wherein x and y are, independently from each other, from 1 to 5, R' is —$COOM_2$ or —OH, $M_1$ and $M_2$ are, independently from each other, hydrogen, ammonium or an alkali metal, R is a straight or a branched carbon chain having from 1 to 8 carbon atoms or an amide of the formula:

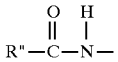

wherein R" is R is a straight or a branched carbon chain having from 1 to 8 carbon atoms.

9. Composition as claimed in claim 8, characterised in that R' is $COOM_2$.

10. Composition as claimed in claim 8, characterised in that R is a straight or a branched carbon chain.

* * * * *